US006692827B2

(12) United States Patent
Luo et al.

(10) Patent No.: US 6,692,827 B2
(45) Date of Patent: Feb. 17, 2004

(54) LYOCELL FIBERS HAVING HIGH HEMICELLULOSE CONTENT

(75) Inventors: Mengkui Luo, Tacoma, WA (US); Vincent A. Roscelli, Edgewood, WA (US); Senén Camarena, Spanaway, WA (US); Amar N. Neogi, Seattle, WA (US); Michael J. Yancey, Puyallup, WA (US); Paul G. Gaddis, Seattle, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/955,711

(22) Filed: Sep. 18, 2001

(65) Prior Publication Data

US 2002/0037407 A1 Mar. 28, 2002

Related U.S. Application Data

(60) Division of application No. 09/185,423, filed on Nov. 3, 1998, now Pat. No. 6,306,334, which is a continuation-in-part of application No. 09/039,737, filed on Mar. 16, 1998, now Pat. No. 6,235,392, which is a continuation-in-part of application No. 08/916,652, filed on Aug. 22, 1997, now abandoned.

(60) Provisional application No. 60/023,909, filed on Aug. 23, 1996, and provisional application No. 60/024,462, filed on Aug. 23, 1996.

(51) Int. Cl.[7] ..... D02G 3/00

(52) U.S. Cl. ..... 428/369; 428/397; 428/399; 428/400; 442/335; 442/336; 442/340; 442/400; 442/401; 442/408; 442/409

(58) Field of Search ..... 428/369, 397, 428/399, 400; 442/335, 336, 340, 400, 401, 408, 409

(56) References Cited

U.S. PATENT DOCUMENTS

| | | | |
|---|---|---|---|
| 2,978,446 | A | 4/1961 | Battista et al. |
| 3,023,104 | A | 2/1962 | Batttista |
| 3,141,875 | A | 7/1964 | Battista et al. |

(List continued on next page.)

FOREIGN PATENT DOCUMENTS

| | | |
|---|---|---|
| EP | 0 785 304 A2 | 7/1997 |
| FR | 2735794 A1 | 12/1996 |
| GB | 2 337 957 A | 8/1999 |

(List continued on next page.)

OTHER PUBLICATIONS

Balk, H., and B. Kunze, "Use of Spinbonding and Melt Blown Microfiber Technology for Filter Media," *Proceedings of the TAPPI Nonwoven Conference*, Macro Island, Fla., 1991, pp. 287–297.

Boman, R., et al., "Transition Metal Removal Before a (PO) Stage in ECF Sequences," *Proceedings of the TAPPI International Pulp Bleaching Conference*, Washington, D.C., 1996, pp. 281–285.

(List continued on next page.)

*Primary Examiner*—Elizabeth M. Cole
*Assistant Examiner*—Norca L. Torres
(74) *Attorney, Agent, or Firm*—Christensen O'Connor Johnson Kindness PLLC

(57) ABSTRACT

The present invention is directed to a lyocell fiber having a high hemicellulose content. The fibers are readily cut into staple lengths and can be spun into yarns with excellent knitting and weaving characteristics which dye exceptionally well. The fibers have a cotton-like denier.

5 Claims, 8 Drawing Sheets

Melt Blown Fiber - 100X

U.S. PATENT DOCUMENTS 3,251,824 A 5/1966 Battista
3,255,071 A 6/1966 Kleinert
3,388,119 A 6/1968 Cruz
3,539,365 A 11/1970 Durand et al.
3,632,469 A 1/1972 Wilder
3,652,385 A 3/1972 Noreus et al.
3,652,386 A 3/1972 Noreus et al.
3,652,387 A 3/1972 Wilder
3,833,438 A 9/1974 Kaneko et al.
3,974,251 A 8/1976 Cremer et al.
4,142,913 A 3/1979 McCorsley et al.
4,144,080 A 3/1979 McCorsley
4,145,532 A 3/1979 Franks et al.
4,159,345 A 6/1979 Takeo et al.
4,196,282 A 4/1980 Franks et al.
4,211,574 A 7/1980 McCorsley et al.
4,246,221 A 1/1981 McCorsley
4,256,613 A 3/1981 Franks et al.
4,290,815 A 9/1981 Henry
4,324,593 A 4/1982 Varga
4,416,698 A 11/1983 McCorsley
4,426,228 A 1/1984 Brandner et al.
4,581,072 A 4/1986 Laity
4,634,470 A 1/1987 Kamide et al.
4,939,016 A 7/1990 Radwanski et al.
5,094,690 A 3/1992 Zikeli et al.
5,189,152 A 2/1993 Hinterholzer et al.
5,216,144 A 6/1993 Eichinger et al.
5,260,003 A 11/1993 Nyssen et al.
5,277,857 A 1/1994 Nicholson et al.
5,310,424 A 5/1994 Taylor
5,330,567 A 7/1994 Zikeli et al.
5,362,867 A 11/1994 Chin et al.
5,370,322 A 12/1994 Gray et al.
5,401,304 A 3/1995 Wykes et al.
5,401,447 A 3/1995 Matsui et al.
5,403,530 A 4/1995 Taylor
5,413,631 A 5/1995 Gray et al.
5,417,909 A 5/1995 Michels et al.
5,421,525 A 6/1995 Gray et al.
5,453,194 A 9/1995 Klein
5,486,230 A 1/1996 Kalt et al.
5,507,983 A 4/1996 Sellars et al.
5,520,869 A 5/1996 Taylor
5,527,178 A 6/1996 White et al.
5,540,874 A 7/1996 Fukui et al.
5,543,101 A 8/1996 Ruf et al.
5,543,511 A 8/1996 Bergfeld et al.
5,545,371 A 8/1996 Lu
5,556,452 A 9/1996 Kalt et al.
5,562,739 A 10/1996 Urben
5,580,354 A 12/1996 Taylor
5,580,356 A 12/1996 Taylor
5,582,783 A 12/1996 Zikeli et al.
5,582,786 A 12/1996 Brunskill et al.
5,582,843 A 12/1996 Sellars et al.
5,587,238 A 12/1996 Meraldi et al.
5,589,125 A 12/1996 Zikeli et al.
5,591,388 A 1/1997 Sellars et al.
5,593,705 A 1/1997 Schilo et al.
5,601,765 A 2/1997 Sellars et al.
5,601,767 A 2/1997 Firgo et al.
5,601,771 A 2/1997 Ruf
5,603,883 A 2/1997 Zikeli
5,605,567 A 2/1997 Lancaster
5,607,639 A 3/1997 Zikeli et al.
5,609,957 A 3/1997 Page et al.
5,618,483 A 4/1997 Weigel et al.
5,626,810 A 5/1997 Zikeli et al.
5,628,941 A 5/1997 Kalt et al.
5,634,914 A 6/1997 Wilkes et al.
5,639,484 A 6/1997 White et al.
5,651,794 A 7/1997 Taylor
5,652,001 A 7/1997 Perry et al.
5,653,931 A 8/1997 Eibl et al.
5,656,224 A 8/1997 Zikeli et al.
5,662,858 A 9/1997 Firgo et al.
5,676,795 A 10/1997 Wizani et al.
5,679,146 A 10/1997 Kalt et al.
5,690,874 A 11/1997 Bell et al.
5,693,296 A 12/1997 Holtzapple et al.
5,695,377 A 12/1997 Tribes et al.
5,709,716 A 1/1998 Taylor
5,725,821 A 3/1998 Gannon et al.
5,759,210 A 6/1998 Potter et al.
5,760,211 A 6/1998 Schleicher et al.
5,762,797 A 6/1998 Patrick et al.
5,766,530 A 6/1998 Kalt et al.
5,779,737 A 7/1998 Potter et al.
5,788,939 A 8/1998 Mulleder et al.
5,795,522 A 8/1998 Firgo et al.
5,977,346 A 11/1999 Saka et al.
6,001,303 A 12/1999 Haynes et al.
6,042,769 A 3/2000 Gannon et al.
6,057,438 A 5/2000 Hyatt et al.
6,183,865 B1 2/2001 Yabuki et al.
6,197,230 B1 3/2001 Pierre et al.
6,210,801 B1 4/2001 Luo et al.
6,221,487 B1 4/2001 Luo et al.
6,235,392 B1 5/2001 Luo et al.
6,306,334 B1 10/2001 Luo et al.

FOREIGN PATENT DOCUMENTS

JP 6-220213 A 8/1994
JP 623 4881 8/1994
JP HEI 6-16222 8/1995
WO WO 94/28218 12/1994
WO WO 95/21901 8/1995
WO WO 95/33883 12/1995
WO WO 95/35399 12/1995
WO WO 95/35400 12/1995
WO WO 96/12063 4/1996
WO WO 96/25552 8/1996
WO WO 96/27700 9/1996
WO WO 97/15713 5/1997
WO WO 97/30196 8/1997
WO WO 98/02662 1/1998
WO WO 98/07911 2/1998
WO WO-9822642 A1 * 5/1998 ..... D01F/2/00
WO WO 98/26122 6/1998
WO WO 98/30740 7/1998
WO WO 99/16960 4/1999
WO WO 98/22642 5/1999
WO WO 99/47733 9/1999

OTHER PUBLICATIONS

Bouchard, J., et al., "A Comparison Between Acid Treatment and Chelation Prior to Hydrogen Peroxide Bleaching of Kraft Pulps," *Pulp and Paper Research Institute of Canada*, 1993.

Chanzy, H., et al., "Dissolution and Spinning of Exploded Wood in Amine Oxide Systems," in Kennedy, J.F., et al. (eds.), *Wood and Cellulosics: Industrial Utilization, Biotechnology, Structure and Properties*, Ellis Harwood Ltd., Chichester, U.K., 1987, pp. 573–579.

Chanzy, H., et al., "Spinning of Exploded Wood From Amine Oxide Solutions," *Polymer Communications 27*:171–172, 1986.

Cole, D.J., "Coutaulds Tencel Fibre in Apparel Fabrics," *Courtaulds Fibres*, May 1992.
Eichinger, D., and M. Eibl, "Lenzing Lyocell—An Interesting Cellulose Fibre for the Textile Industry," *Talk held at 34th IFC*, Dornbirn, Austria, 1995.
Gurnagul, N., et al., "The Effect of Cellulose Degradation on the Strength of Wood Pulp Fibres," *Pulp and Paper Research Institute of Canada*, 1992.
Hill, R. T., et al., "Transition Metal Control for Peroxygen Bleaching a Sulfite Pulp," *Proceedings of the TAPPI Pulping Conference*, Houston, Texas, 1994, pp. 489–500.
Humphrey, A.E., "The Hydrolysis of Cellulosic Materials to Useful Products," *Hydrolysis of Cellulose*, 1978, pp. 25–53.
Ingruber, O. V., et al. (eds.), *Pulp and Paper Manufacture*, vol. 4, *Sulfite Science & Technology*, 3d ed., Joint Textbook Committtee of the Paper Industry, Atlanta, 1985, pp. 229–243.
Johnson, P., "Courtaulds Lyocell—A Cellulosic Fibre for Special Papers and Nonwovens," *Proceedings of the TAPPI Nonwovens Conference*, Macro Island, Fla., 1996, pp. 245–248.
Kamide, K., et al., "Structural Change in Alkali–Soluble Cellulose Solid During Its Dissolution Into Aqueous Alkaline Solution," *Cellulose Chem. Technol. 24*:23–31, 1990.
Kamide, K., et al., "Dissolution of Natural Cellulose Into Aqueous Alkali Solution: Role of Super–Molecular Structure of Cellulose," *Polymer Journal 24*:71–86, 1992.
Krüger, R., "Cellulosic Filament Yarn From the NMMO Process," *Presentation at the Int. Chemiefaser–Tagung*, Dornbirn, Austria, 1993.
Lipinksy, E.S., "Perspectives on Preparation of Cellulose for Hydrolysis," *Hydrolysis of Cellulose*, 1978, pp. 1–23.
Luo, M., "Characterization of Cellulose and Galactomannan Blends From the N–Methylmorpholine N–Oxide/Water Solvent System," doctoral dissertation, State University of New York, Syracuse, N. Y., Apr. 1994.
Marini, I., et al., "Lenzing Lyocell," *Presentation at the Int. Chemiefaser–Tagung*, Dornbirn, Austria, 1993.
Michels, C., et al., "The Aminoxide Process Developed in the TITK," *Talk held at Thüringisches Institut für textil– und Kunstsoff–Forschung*, Rudolstadt, Germany, Sep. 1994.
Michels, C., et al., "Besonderheiten Des im TITK Entwickelten Aminooxidprozesses," *Lenzinger Berichte*, Austria, 1994, pp. 57–60.
Mieck, K.–P., et al., "Examination of the Fibrillation Tendency of Cellulosic Man–Made Spun Fibres With Different Fibre Formation Mechanisms," *Presentation at the Int. Chemiefaser–Tagung*, Dornbirn, Austria, 1993.
Mortimer, S.A., and A.A. Péguy, "Methods for Reducing the Tendency of Lyocell Fibers to Fibrillate," *J. Appl. Polym. Sci. 60*:305–316, 1996.
Nicolai, M., et al., "Textile Crosslinking Reactions to Reduce the Fibrillation Tendency of Lyocell Fibers," *Textile Res. J. 66*(9):575–580, 1996.
Robert, A., et al., "Possible Uses of Oxygen in Bleaching Cellulose Pulps. (2). Bleaching Cellulose Pulps Previously Treated With Oxygen," *ATIP Bulletin 18*(4):166–176, 1964.
Trimble, L.E., "The Potential for Meltblown," in Vargas, E. (ed.), *Meltblown Technology Today*, Miller Freeman Publications, San Francisco, 1989, pp. 139–149.
Vargas, E. (ed.), *Meltblown Technology Today*, Miller Freeman Publications, San Francisco, 1989, pp. 7–26, 71, 77.
Woodings, C.R., "Fibers (Regenerated Cellulosics)," vol. 10, *Encyclopedia of Chemical Technology*, 4th ed., John Wiley & Sons, 1993, pp. 696–726.
Yamashiki, T., et al., "Characterisation of Cellulose Treated by the Steam Explosion Method. Part 1: Influence of Cellulose Resources on Changes in Morphology, Degree of Polymerisation, Solubility and Solid Structure," *British Polymer Journal 22*:73–83, 1990.
Yamashiki, T. et al., "Characterisation of Cellulose Treated by the Steam Explosion Method. Part 2: Effect on Treatment Conditions on Changes in Morphology, Degree of Polymerisation, Solubility in Aqueous Sodium Hydroxide and Supermolecular Structure of Soft Wood Pulp During Steam Explosion, " *British Polymer Journal 22*:121–128, 1990.
Yamashiki, T., et al., "Characterisation of Cellulose Treated by the Steam Explosion Method. Part 3: Effect of Crystal Forms (Cellulose I, II and III) of Original Cellulose on Changes in Morphology, Degree of Polymerisation, Solubility and Supermolecular Structure by Steam Explosion," *British Polymer Journal 22*:201–212, 1990.
Yuan, Z., et al., "The Role of Transition Metal Ions During Peracetic Acid Bleaching of Chemical Pulps," *83rd Annual Meeting, Technical Section, CPPA*, Montreal, 1997, pp. 1–8.
Zhang, X.–Z., and R.C. Francis, "The Role of Transition Metal Species in Delignification With Distilled Peracetic Acid," *J. Wood Chemistry and Technology 18*(3):253–266, 1998.

* cited by examiner

Commercial Lyocell Fiber - 100X

Commercial Lyocell Fiber - 10,000X

Melt Blown Fiber - 100X

Melt Blown Fiber - 10,000X

Abraded Commercial Fiber 1 - 1000X

Abraded Commercial Fiber 2 - 1000X

Abraded Melt Blown Fiber 1 - 1000X

Abraded Melt Blown Fiber 2 - 1000X

LYOCELL FIBERS HAVING HIGH HEMICELLULOSE CONTENT

CROSS-REFERENCE TO RELATED APPLICATIONS

This application is a divisional of U.S. application Ser. No. 09/185,423, filed Nov. 3, 1998, now U.S. Pat. No. 6,306,334, which in turn is a continuation-in-part of U.S. application Ser. No. 09/039,737, filed Mar. 16, 1998, now U.S. Pat. No. 6,235,392, which in turn is a continuation-in-part of U.S. application Ser. No. 08/916,652, filed Aug. 22, 1997, now abandoned, and claims the benefit of U.S. Provisional Application No. 60/023,909 and No. 60/024,462, both filed Aug. 23, 1996.

FIELD OF THE INVENTION

The present invention is directed to lyocell fibers having a high hemicellulose content. The fibers are readily cut into staple lengths and can be spun into yarns with excellent knitting and weaving characteristics which dye exceptionally well. The fibers have a cotton-like denier.

BACKGROUND OF THE INVENTION

For over a century strong fibers of regenerated cellulose have been produced by the viscose and cuprammonium processes. The latter process was first patented in 1890 and the viscose process two years later. In the viscose process cellulose is first steeped in a mercerizing strength caustic soda solution to form an alkali cellulose. This is reacted with carbon disulfide to form cellulose xanthate which is then dissolved in dilute caustic soda solution. After filtration and deaeration the xanthate solution is extruded from submerged spinnerets into a regenerating bath of sulfuric acid, sodium sulfate, zinc sulfate, and glucose to form continuous filaments. The resulting so-called viscose rayon is presently used in textiles and was formerly widely used for reinforcing in rubber articles such as tires and drive belts.

Cellulose is also soluble in a solution of ammoniacal copper oxide. This property formed the basis for production of cuprammonium rayon. The cellulose solution is forced through submerged spinnerets into a solution of 5% caustic soda or dilute sulfuric acid to form the fibers. After decoppering and washing the resulting fibers have great wet strength. Cuprammonium rayon is available in fibers of very low deniers and is used almost exclusively in textiles.

More recently other cellulose solvents have been explored. One such solvent is based on a solution of nitrogen tetroxide in dimethyl formamide. While much research was done, no commercial process has resulted for forming regenerated cellulose fibers using this solvent.

The usefulness of tertiary amine-N oxides as cellulose solvents has been known for a considerable time. Graenacher, in U.S. Pat. No. 2,179,181, discloses a group of amine oxide materials suitable as solvents. However, the inventor was only able to form solutions with low concentrations of cellulose and solvent recovery presented a major problem. Johnson, in U.S. Pat. No. 3,447,939, describes the use of anhydrous N-methylmorpholine-N-oxide (NMMO) and other amine N-oxides as solvents for cellulose and many other natural and synthetic polymers. Again the solutions were of relatively low solids content. In his later U.S. Pat. No. 3,508,941, Johnson proposed mixing in solution a wide variety of natural and synthetic polymers to form intimate blends with cellulose. A nonsolvent for cellulose such as dimethylsulfoxide was added to reduce dope viscosity. The polymer solution was spun directly into cold methanol but the resulting filaments were of relatively low strength.

However, beginning in 1979 a series of patents were issued to preparation of regenerated cellulose fibers using various amine oxides as solvents. In particular, N-methylmorpholine-N-oxide with about 12% water present proved to be a particularly useful solvent. The cellulose was dissolved in the solvent under heated conditions, usually in the range of 90° C. to 130° C., and extruded from a multiplicity of small diameter spinnerets into air. The filaments of cellulose dope are continuously mechanically drawn in air by a factor in the range of about three to ten times to cause molecular orientation. They are then led into a nonsolvent, usually water, to regenerate the cellulose. Other regeneration solvents, such as lower aliphatic alcohols, have also been suggested. Examples of the process are detailed in McCorsley and McCorsley et al., U.S. Pat. Nos. 4,142,913; 4,144,080; 4,211,574; 4,246,221, and 4,416,698 and others. Jurkovic et al., in U.S. Pat. No 5,252,284 and Michels et al., in U.S. Pat. No. 5,417,909 deal especially with the geometry of extrusion nozzles for spinning cellulose dissolved in NMMO. Brandner et al., in U.S. Pat. No. 4,426,228, is exemplary of a considerable number of patents that disclose the use of various compounds to act as stabilizers in order to prevent cellulose and/or solvent degradation in the heated NMMO solution. Franks et al., in U.S. Pat. Nos. 4,145,532 and 4,196,282, deal with the difficulties of dissolving cellulose in amine oxide solvents and of achieving higher concentrations of cellulose.

Cellulose textile fibers spun from NMMO solution are referred to as lyocell fibers. Lyocell is an accepted generic term for a fiber composed of cellulose precipitated from an organic solution in which no substitution of hydroxyl groups takes place and no chemical intermediates are formed. One lyocell product produced by Courtaulds, Ltd. is presently commercially available as Tencel® fiber. These fibers are available in 0.9–2.7 denier weights and heavier. Denier is the weight in grams of 9000 meters of a fiber. Because of their fineness, yarns made from Tencel® lyocell produce fabrics having extremely pleasing hands.

One limitation of the lyocell fibers made presently is a function of their geometry. They are continuously formed and typically have quite uniform, generally circular or oval cross sections, lack crimp as spun, and have relatively smooth, glossy surfaces. This makes them less than ideal as staple fibers since it is difficult to achieve uniform separation in the carding process and can result in non-uniform blending and uneven yarn. In part to correct the problem of straight fibers, man made staple fibers are almost always crimped in a secondary process prior to being chopped to length. Examples of crimping can be seen in U.S. Pat. Nos. 5,591,388 or 5,601,765 to Sellars et al. where the fiber tow is compressed in a stuffer box and heated with dry steam. It might also be noted that fibers having a continuously uniform cross section and glossy surface produce yarns tending to have a "plastic" appearance. Yarns made from thermoplastic polymers frequently must have delustering agents, such as titanium dioxide, added prior to spinning. Wilkes et al., in U.S. Pat. No. 5,458,835, teach the manufacture of viscose rayon fibers having cruciform and other cross sections. U.S. Pat. No. 5,417,909 to Michels et al. discloses the use of profiled spinnerets to produce lyocell fibers having non-circular cross sections but the present inventors are not aware of any commercial use of this method.

Two widely recognized problems of lyocell fabrics are caused by fibrillation of the fibers under conditions of wet abrasion, such as might result during laundering. Fibrillation tends to cause "pilling"; i.e., entanglement of fibrils into small relatively dense balls. It is also responsible for a "frosted" appearance in dyed fabrics. Fibrillation is believed to be caused by the high degree of molecular orientation and apparent poor lateral cohesion within the fibers. There is an extensive technical and patent literature discussing the problem and proposed solutions. As examples, reference might be made to papers by Mortimer, S. A. and A. A. Péguy, *Journal of Applied Polymer Science,* 60:305–316 (1996) and Nicholai, M., A. Nechwatal, and K. P. Mieck, *Textile Research Journal* 66(9):575–580 (1996). The first authors attempt to deal with the problem by modifying the temperature, relative humidity, gap length, and residence time in the air gap zone between extrusion and dissolution. Nicholai et al. suggest crosslinking the fiber but note that " . . . at the moment, technical implementation [of the various proposals] does not seem to be likely". A sampling of related United States patents might include those to Taylor, U.S. Pat. Nos. 5,403,530, 5,520,869, 5,580,354, and 5,580,356; Urben, U.S. Pat. No. 5,562,739; and Weigel et al. U.S. Pat. No. 5,618,483. These patents mostly relate to treatment of the fibers with reactive materials to induce surface modification or crosslinking. Enzymatic treatment of yarns or fabrics is currently the preferred way of reducing problems caused by fibrillation. However, all of the treatments noted have disadvantages and increase the cost. A fiber that was resistant to fibrillation would be a significant advantage.

Low denier fibers from synthetic thermoplastic polymers have been produced by a number of extrusion processes. One, termed "melt blowing", is particularly relevant to the present invention. The molten polymers are extruded through a series of small diameter orifices into a high velocity air stream flowing generally parallel to the extruded fibers. This draws or stretches the fibers as they cool. The stretching serves two purposes. It causes some degree of longitudinal molecular orientation and reduces the ultimate fiber diameter. Melt blown fibers were initially formed from polypropylene but have since been made from many polymers. They are generally termed "microfibers" since their diameter is most usually less than 10 $\mu$m (approximately 1 denier). There is an extensive patent and general technical literature on the process since it has been commercially important since the early 1970s. Exemplary patents to melt blowing are Weber et al., U.S. Pat. No. 3,959,421, and Milligan et al., U.S. Pat. No. 5,075,068. The Weber et al. patent uses a water spray in the gas stream to rapidly cool the fibers. A somewhat related process is described in PCT Publication WO 91/18682 which is directed to a method for coating paper by modified melt blowing. Coating materials suggested are aqueous liquids such as "an aqueous solution of starch, carboxymethylcellulose, polyvinyl alcohol latex, a suspension of bacterial cellulose, or any aqueous material, solution or emulsion". However, this process actually atomizes the extruded material rather than forms it into latent fibers. Zikeli et al., in U.S. Pat. Nos. 5,589,125 and 5,607,639, direct a stream of air transversely across strands of extruded lyocell dope as they leave the spinnerets. This air stream serves only to cool and does not act to stretch the filaments. French laid open application 2,735,794 describes formation of lyocell fibers by a process of melt blowing. However, these are highly fragmented microfibers useful principally for production of self bonded non-woven webs.

Extremely fine fibers, termed "microdenier fibers" generally are regarded as those having a denier of 1.0 or less. Meltblown fibers produced from various synthetic polymers, such as polypropylene, nylons, or polyesters are available with diameters as low as 0.4 $\mu$m (approximately 0.001 denier). However, the strength or "tenacity" of most of these fibers tends to be low and their generally poor water absorbency is a negative factor when they are used in fabrics for clothing. Microdenier cellulose fibers, as low as 0.5 denier, have been produced before the present only by the viscose process.

The present process can produce a unique lyocell fiber in the cotton diameter or finer range that overcomes many of the limitations of presently available lyocell fibers, rayons, or other fibers produced from synthetic polymers. It overcomes many of the limitations of the present process for making continuous lyocell fibers. The process uses much larger spinning orifices enabling a higher dope throughput per orifice with a greatly reduced tendency for orifice plugging due to small bits of unfiltered foreign matter in the dope.

The surface of each fiber produced by the process tends to be pebbled, as seen at high magnification, and the fibers have a cross section of varying shape and diameter along their length, have significant natural crimp, are resistant to fibrillation under conditions of wet abrasion, and have excellent dyeability. All of these are desirable characteristics found in most natural fibers but missing in lyocell fibers produced commercially to the present.

With the exception of the French laid open application, processes analogous to melt blowing have never been used with cellulosic materials since cellulose itself is basically infusible. Melt blowing has never before to applicants' knowledge been used for preparation of continuous textile denier cellulose fibers.

SUMMARY OF THE INVENTION

The present invention is directed to a process for production of regenerated cellulose fibers and to the fibers so produced. The terms "cellulose" and "regenerated cellulose" as used here should be construed sufficiently broadly to encompass blends of cellulose with other natural and synthetic polymers, mutually soluble in a spinning solvent, in which cellulose is the principal component by weight. In particular it is directed to fibers produced from cellulose solutions in amine N-oxides by processes analogous to melt blowing. Where the term "melt blowing" is used it will be understood that it refers to a process that is similar or analogous to the process used for production of thermoplastic fibers, even though the cellulose is in solution and the spinning temperature is only moderately elevated. The term "continuously drawn" refers to the present commercial process for manufacture of lyocell fibers where they are extruded and mechanically pulled, first through an air gap to cause elongation and molecular orientation and then through a regeneration bath.

The processes involve dissolving a cellulosic raw material in a suitable solvent. Most usually this will be an amine oxide, preferably N-methylmorpholine-N-oxide (NMMO) with some water present. Other solvents can be used either by themselves or in admixture with NMMO; e.g., the depolymerized nylon monomers as shown in Chin et al., U.S. Pat. No. 5,362,867. Where the term "cellulose solution in NMMO" or similar language is used it should be understood that it is intended to be read broadly and include other suitable solvents or solvent mixtures. This dope, or cellulose solution in NMMO, can be made by known technology; e.g., as is discussed in any of the McCorsley or Franks et al. patents aforenoted. In the present process, the dope is then transferred at somewhat elevated temperature to the spinning apparatus by a pump or extruder at temperatures from 70° C. to 140° C. Ultimately the dope is directed to an extrusion head having a multiplicity of spinning orifices. The dope filaments emerge into a relatively high velocity turbulent gas stream flowing in a generally parallel direction to the path of the latent fibers. As the cellulose solution is extruded through the orifices the liquid strands or latent filaments are drawn (or significantly decreased in diameter and increased in length) during their continued trajectory after leaving the orifices. The turbulence induces a natural crimp and some variability in ultimate fiber diameter both between fibers and along the length of individual fibers. The crimp is irregular and will have a peak to peak amplitude that is usually greater than about one fiber diameter with a period usually greater than about five fiber diameters. At some point in their trajectory the fibers are contacted with a regenerating solution. Regenerating solutions are nonsolvents such as water, lower aliphatic alcohols, or mixtures of these. The NMMO used as the solvent can then be recovered from the regenerating bath for reuse. Preferably the regenerating solution is applied as a fine spray at some predetermined distance below the extrusion head.

Turbulence and oscillation in the air around the latent fiber strands is believed to be responsible for their unique geometry when made by the melt blowing process.

A great number of variables can contribute to fiber morphology. These may be loosely grouped as dope variables and spinning variables. The dope variables may affect the dope viscosity and may heavily influenced by cellulose degree of polymerization (D.P.). This, in turn, may affect allowable cellulose concentration and ultimate throughput rate. The characteristics of the cellulose itself are important; e.g., the type of pulping process and the subsequent bleaching sequence. These affect not only D.P. but such properties as α-cellulose and hemicellulose as well as ease or difficulty of dissolving the cellulose in the spinning solvent. Solvent composition is also an important factor; e.g., the solvent mixture described in U.S. Pat. No. 5,362,867 will give a lower viscosity dope at a given cellulose concentration than will the NMMO/water mixture. Spinning variables include but are not limited to extrusion head temperature, air temperature, air velocity, the mass ratio of air to dope, dope throughput rate, orifice configuration and the temperature profile along the orifice, and regeneration procedure. Other important variables relate to width of the extrusion head nosepiece; i.e., the distance from nozzle centers to the air exit ports, width and configuration of the air exit ports and angle of the air stream relative to the centerlines of the nozzles. The term "orifice configuration" refers not only to the orifice itself but includes any lead in capillary section. Orifice diameter and the length/diameter ratio and the presence or absence of a capillary preceding the orifice have been found to be quite important for production of continuous fibers with minimum die swell at the orifice exit.

The present method is capable of production rates of at least 1 g/min of dope per spinning orifice. This is considerably greater than the throughput rate of present commercial processes. Further, the fibers have a tensile strength averaging at least 2 g/denier and can readily be produced within the range of 4–100 μm in diameter, preferably about 5–30 μm. A most preferred fiber diameter is about 9–20 μm, approximately the range of natural cotton fibers. These fibers are especially well suited as textile fibers but could also find applications in filtration media, absorbent products, and nonwoven fabrics as examples.

In the case of the present invention, the pulp may be a high α-cellulose type, generally known as a chemical pulp, or it may be a lower grade pulp. Kraft process pulps have been found satisfactory. The α value of a pulp is a measure of the amount of α-cellulose present in the pulp, i.e., cellulose composed of glucose monomers. The higher the α value of a pulp, the higher is the amount of α cellulose. The α value of a pulp can be determined by TAPPI test T203OM-88 which is well known to one of ordinary skill in the pulping art. In addition to α-cellulose, pulp also contains hemicelluloses which are branched, low molecular weight polysaccharides associated in the plant cell wall with α-cellulose and lignin. Hemicelluloses are formed from several different monosaccharides, such as mannose, galactose and arabinose. Thus, pulps having a low α value contain a larger proportion of hemicelluloses compared to pulps having a high α value.

High α-pulps typically have an α-value of greater than about to 90%, more typically greater than about 94%. Lower grade pulps (low α pulps) typically have an α-value of less than 90%, usually in the range of from about 83% to about 89%. The ability to use lower α pulps is a major advantage of the present process since they generally require less expensive processing.

With respect to the degree of polymerization (D.P.) of pulps that are useful in the practice of the present invention, the process of the present invention can utilize a pulp having a D.P. of from about 150 to about 3000; preferably from about 300 to about 1000; most preferably about 600. Fibers formed from pulp having a D.P. at or near the lower end of the foregoing D.P. range will typically have a reduced fiber strength relative to fibers formed from pulp having a higher D.P. Thus, for example, fibers formed from pulp having a D.P. of from about 150 to about 200 will primarily be useful in the manufacture of non-woven materials in which individual fiber strength is not a significant concern.

A preferred pulp useful in the practice of the present invention will be in roll form and will have a low α value, preferably less than about 90%, and a low D.P., preferably from about 300 to about 1000; most preferably about 600.

The hemicellulose content of the lyocell fibers produced in accordance with the process of the present invention is somewhat less than the hemicellulose content of the cellulosic starting material. Using the preferred pulp of the present invention as a starting material, the resulting lyocell fibers have been observed to have a hemicellulose content of from about 13% to about 15%.

With respect to the concentration of dissolved cellulose utilized in the process of the present invention, in general it is desirable to use a higher concentration of cellulose since a higher concentration of cellulose enables higher cellulose throughput per orifice for a unit of time. On the other hand, it will be understood that the viscosity of a cellulose solution varies directly with the average D.P. of the cellulose, i.e., the higher the D.P., the greater will be the viscosity of the cellulose in solution. Consequently, the useful concentration of a high D.P. pulp will typically be lower than the useful concentration of a low D.P. pulp. Thus, for example, in the practice of the present invention the concentration of cellulose having a D.P. of 3000 will typically be about 1% while the concentration of cellulose having a D.P. of about 150 will typically be from about 25% to about 30%. Again, by way of non-limiting example, in the practice of the present invention the concentration of cellulose having a D.P. of from about 800 to about 1000 will typically be from about 18% to about 20% while the concentration of cellulose having a D.P. of about 600 will typically be from about 8% to about 9%. One of ordinary skill in the pulping art will understand, however, that factors such as the temperature of the dissolved cellulose and the chemical properties of the solvent will also affect the useful concentration of dissolved cellulose.

A preferred starting cellulose material is a bleached kraft market pulp modified to a D.P. range of about 300–1000, most preferably about 600. This permits cellulose concentrations in the dope to range between about 8–18%. Typical kraft market pulps of this type have a D.P. of about 1200–1500. One way the D.P. may be reduced is by acid hydrolysis at any point before, after, or during the bleaching process. Any acid may be utilized, such as hydrochloric acid or sulphuric acid. The acid may be utilized in the form of a liquid, or may be formed from a gas, such as by dissolving hydrogen chloride gas in an aqueous medium. Other known methods of D.P. control are equally suitable. For example, another method is by swelling the cellulose in an alkaline solution followed by alkali removal and treatment with a cellulolytic enzyme, preferably one of the endogluconase types (hereinafter referred to as alkaline enzymatic degradation). Steam explosion may also be utilized Further, a combination of methods of D.P. reduction can be utilized, such as steam explosion combined with acid hydrolysis. An advantage of utilizing acid hydrolysis to reduce D.P. is that transition metal contaminants in the pulp are removed by the acid treatment. If an acid treatment step is not utilized, then an alternative method of removing transition metals from the pulp can be utilized, such as treatment of the pulp with a chelating agent. Although, a preferred starting cellulose material is a bleached kraft market pulp, reduction of D.P. can be effected before, during or after bleaching of the pulp. Preferably, the reduction of degree of polymerization is made such that sufficient fiber is maintained so that the treated pulp can be processed into roll form. However, it is contemplated that treated pulp can be processed into bale form for shipping. Pulps that have been treated to reduce their D.P. in accordance with any of the foregoing methods will typically dissolve faster in amine oxide solvents, such as NMMO with less undesirable gelation.

Spinning orifice diameter may be in the 300–600 $\mu$m range, preferably about 400–500 $\mu$m. with a L/D ratio in the range of about 2.5–10. Most desirably a lead in capillary of greater diameter than the orifice is used. The capillary will normally be about 1.2–2.5 times the diameter of the orifice and will have a L/D ratio of about 10–250. Commercial lyocell fibers are spun with very small orifices in the range of 60–80 $\mu$m. The larger orifice diameters of the present invention are advantageous in that they are one factor allowing much greater throughput per unit of time, throughputs that equal or exceed 1 g/min/orifice. Further, they are not nearly as susceptible to plugging from small bits of foreign matter or undissolved fibers in the dope as are the smaller nozzles. The larger nozzles are much more easily cleaned if plugging should occur and construction of the extrusion heads is considerably simplified. Operating temperature and temperature profile along the orifice and capillary should fall within the range of about 70° C. to 140° C. It seems beneficial to have a rising temperature near the exit of the spinning orifices. There are many advantages to operation at as high a temperature as possible, up to about 140° C. where NMMO begins to decompose. Among these advantages, throughput rate may generally be increased at higher dope temperatures. By profiling orifice temperature, the decomposition temperature may be safely approached at the exit point since the time the dope is held at or near this temperature is very minimal. Air temperature as it exits the melt blowing head is broadly critical and should be in the 40°–100° C. range, preferably about 60° C.

Certain defects are known to be associated with melt blowing. "Shot" is a glob of polymer of significantly larger diameter than the fibers. It principally occurs when a fiber is broken and the end snaps back. Shot is often formed when process rates are high and melt and air temperatures and airflow rates are low. "Fly" is a term used to describe short fibers formed on breakage from the polymer stream. "Rope" is used to describe multiple fibers twisted and usually bonded together. Fly and rope occur at high airflow rates and high die and air temperatures. "Die swell" occurs at the exit of the spinning orifices when the emerging polymer stream enlarges to significantly greater diameter than the orifice diameter. This occurs because polymers, particularly molecularly oriented polymers, do not always act as true liquids. When molten polymer streams are held under pressure, expansion occurs upon release of the pressure. Orifice design is critical for controlling die swell.

Melt blowing of thermoplastics has been described by R. L. Shambaugh, *Industrial and Engineering Chemistry Research* 27:2363–2372 (1988) as operating in three regions. Region I has relatively low gas velocity similar to commercial "melt spinning" operations where fibers are continuous. Region II is an unstable region which occurs as gas velocity is increased. The filaments break up into fiber segments. Region III occurs at very high air velocities with excessive fiber breakage. In the present process air velocity, air mass flow and temperature, and dope mass flow and temperature are chosen to give operation in Region I as above described where a shot free product of individual continuous fibers in a wide range of deniers can be formed. The operating conditions in French Patent application 2,735,794, noted earlier, appear to be high in Region II or possibly into Region III.

The extruded latent fiber filaments carried by the gas stream are preferably regenerated by a fine water spray during the later part of their trajectory. They are received on a take-up roll or moving foraminous belt where they may be transported for further processing. The take-up roll or belt will normally be operated at a speed somewhat lower than that of the arriving fibers so that there is no or only minimal tension placed on the arriving fibers.

Filaments having an average size as low as 0.1 denier or even less can be readily formed. Denier can be controlled by a number of factors including but not limited to orifice diameter, gas stream speed, dope viscosity and throughput rate. Dope viscosity is, in turn, largely a factor of cellulose D.P. and concentration. Gloss or luster of the fibers is considerably lower than continuously drawn lyocell fiber lacking a delusterant so they do not have a "plastic" appearance. This is believed to be due to their unique "pebbled" surface apparent in high magnification scanning electron micrographs.

By properly controlling spinning conditions the fibers can be formed with variable cross sectional shape and a relatively narrow distribution of fiber diameters. Some variation in diameter and cross sectional configuration will typically occur along the length of individual fibers and between fibers. The fibers are unique for regenerated cellulose and similar in morphology to many natural fibers.

Fibers produced by the melt blowing process possess a natural crimp quite unlike that imparted by a stuffer box. Crimp imparted by a stuffer box is relatively regular, has a relatively low amplitude, usually less than one fiber diameter, and short peak-to-peak period normally not more than two or three fiber diameters. That of the present fibers has an irregular amplitude usually greater than one fiber diameter and an irregular period usually exceeding about five fiber diameters, a characteristic of fibers having a curly or wavy appearance.

Quite unexpectedly, the fibers of the present invention appear to be highly resistant to fibrillation under conditions of wet abrasion. This is a major advantage in that no post-spinning processing is required, such as crosslinking or enzymatic treatment.

Properties of the fibers of the present invention are well matched for carding and spinning or knitting in conventional textile manufacturing processes. The fibers have many of the attributes of natural fibers. They have been found to accept dyes exceptionally well.

The process is particularly well suited for making lyocell fiber in the 5–30 $\mu$m diameter range at throughputs that equal or exceed at least 1 g of dope per minute per spinning orifice. It is particularly well suited for making fiber in the 10–20 $\mu$m cotton denier range. Fiber average strength has been found to equal or exceed about 2 g/denier.

A particular advantage of the present invention is the ability to form blends of cellulose with what might otherwise be considered as incompatible polymeric materials. The amine oxides are extremely powerful solvents and can dissolve many other polymers beside cellulose. It is thus possible to form blends of cellulose with materials such as lignin, nylons, polyethylene oxides, polypropylene oxides, poly(acrylonitrile), poly(vinylpyrrolidone), poly(acrylic acid), starches, poly(vinyl alcohol), polyesters, polyketones, casein, cellulose acetate, amylose, amylopectins, cationic starches, and many others. Each of these materials in homogeneous blends with cellulose can produce fibers having new and unique properties.

It is an object of the present invention to provide a method of forming regenerated cellulose fibers or cellulose blend fibers from solution in an amine oxide-water or other solvent by a process analogous to melt blowing.

It is a further object to provide a method for making lyocell fibers having advantageous geometry and surface characteristics for forming into yarns.

It is still an object to provide a method for making lyocell fibers having natural crimp and low luster.

It is an additional object to provide a method for forming a lyocell fiber resistant to fibrillation under conditions of wet abrasion.

It is yet an object to provide a method of forming fibers of the above types by a process in which all production chemicals can be readily recovered and reused.

It is an important object to provide lyocell fibers having superior dyeing characteristics.

It is also an object to provide regenerated cellulose fibers having many properties similar or superior to natural fibers.

A farther object is to provide a method of lyocell fiber production at a high rate of throughput per spinning orifice.

Yet another object is to provide a method of production of lyocell fibers in which fiber production is not normally interrupted by small air bubbles or foreign matter which might cause fiber breaks.

Another object of the present invention is to make lyocell fibers having a hemicellulose contents of from about 13% to about 15%.

These and many other objects will become readily apparent to those skilled in the art upon reading the following detailed description in conjunction with referral to the drawings.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The process of the present invention is adaptable to any cellulosic raw material. It may be bleached or unbleached wood pulp which can be made by various processes of which kraft, prehydrolyzed kraft, or sulfite would be exemplary. Many other cellulosic raw materials, such as purified cotton linters, are equally suitable. Prior to dissolving in the amine oxide solvent the cellulose, if sheeted, is normally shredded into a fine fluff to promote ready solution.

The solution of the cellulose can be made in a known manner; e.g., as taught in McCorsley U.S. Pat. No. 4,246,221. Here the cellulose is wet in a nonsolvent mixture of about 40% NMMO and 60% water. The ratio of cellulose to wet NMMO is about 1:5.1 by weight. The mixture is mixed in a double arm sigma blade mixer for about 1.3 hours under vacuum at about 120° C. until sufficient water has been distilled off to leave about 12–14% based on NMMO so that a cellulose solution is formed. Alternatively, NMMO of appropriate water content may be used initially to obviate the need for the vacuum distillation. This is a convenient way to prepare spinning dopes in the laboratory where commercially available NMMO of about 40–60% concentration can be mixed with laboratory reagent NMMO having only about 3% water to produce a cellulose solvent having 7–15% water. Moisture normally present in the cellulose should be accounted for in adjusting necessary water present in the solvent. Reference might be made to articles by Chanzy, H. and A. Péguy, *Journal of Polymer Science, Polymer Physics Ed.* 18:1137–1144 (1980) and Navard, P. and J. M. Haudin British Polymer Journal, p 174, December 1980 for laboratory preparation of cellulose dopes in NMMO water solvents.

Figure 1:
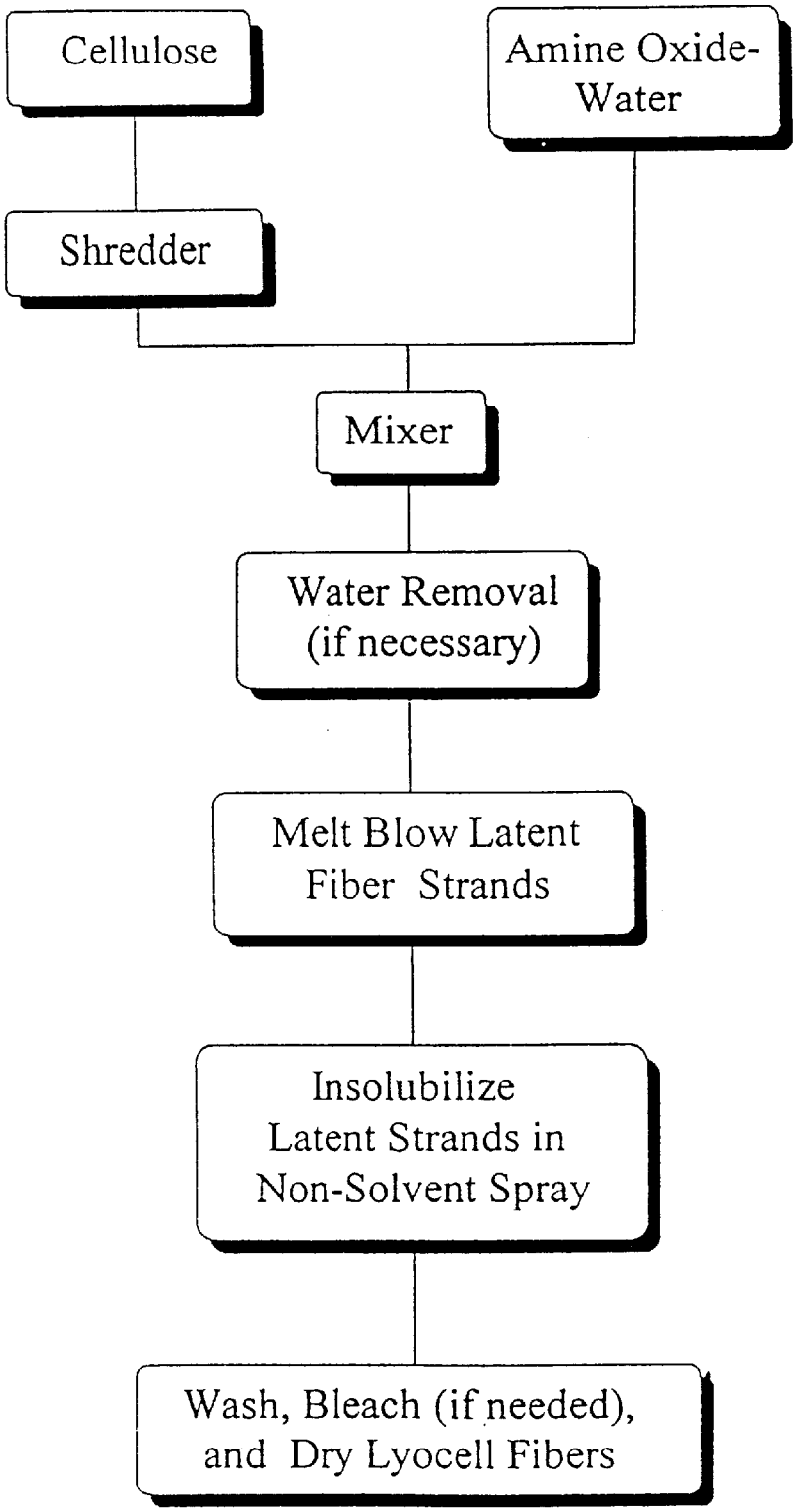
FIG. 1 is a block diagram of the steps used in practice of the present process.

Reference to FIG. 1 will show a block diagram of the present process. The cellulose solution is forced from extrusion orifices into a turbulent air stream rather than directly into a regeneration bath as is the case with viscose or cuprammonium rayon. Only later are the latent filaments regenerated. However, the present process also differs from the conventional processes for forming lyocell fibers since the dope is not continuously mechanically pulled linearly downward as unbroken threads through an air gap and into the regenerating bath.

Figure 2:
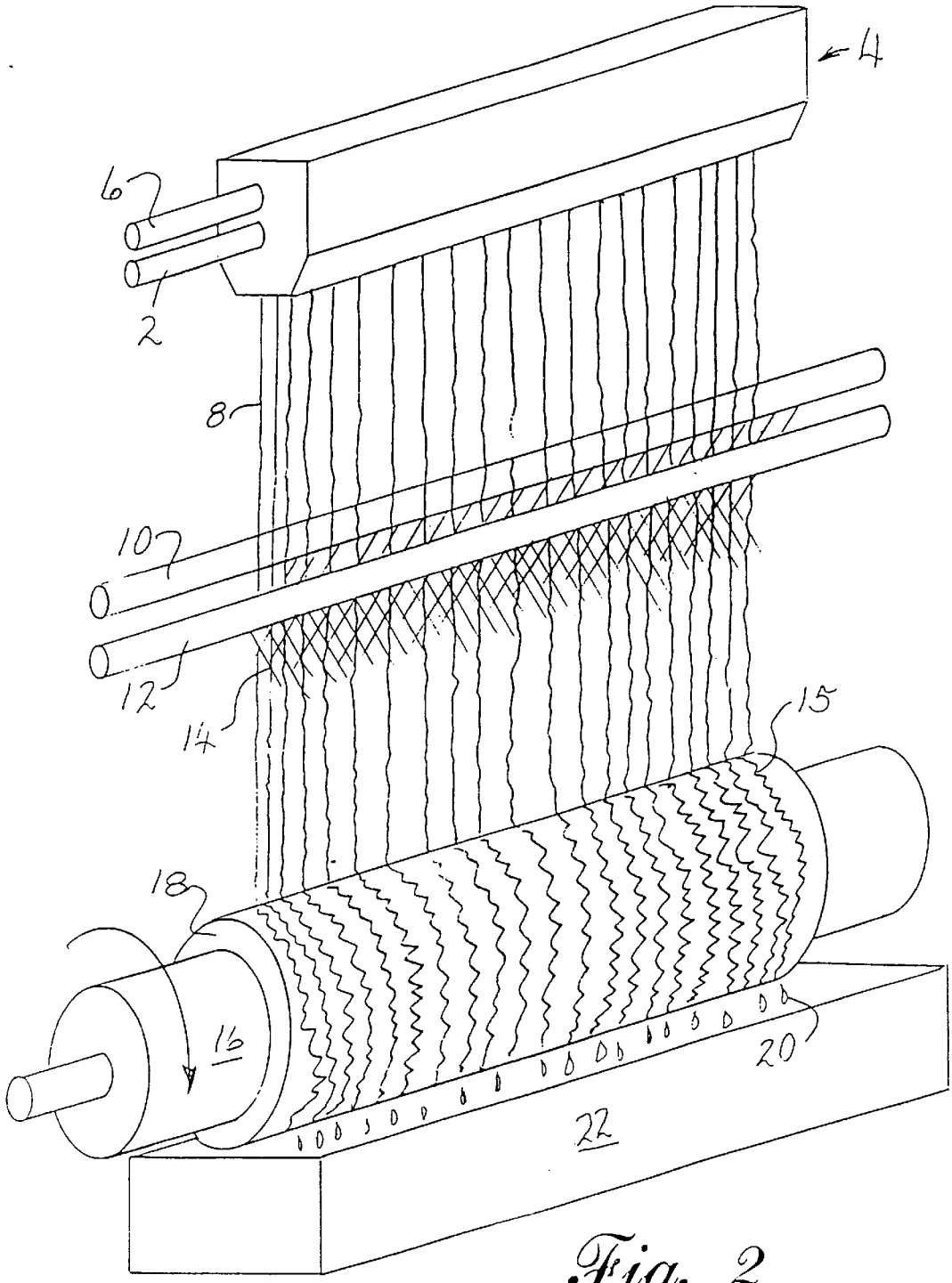
FIG. 2 is a partially cut away perspective representation of typical melt blowing equipment used with the invention.

FIG. 2 shows details of a typical melt blowing process. A supply of dope is directed through an extruder and positive displacement pump, not shown, through line 2 to an extrusion head 4 having a multiplicity of orifices. Compressed air or another gas is supplied through line 6. Latent fibers 8 are extruded from orifices 40 (seen in FIG. 3). These thin strands of dope 8 are picked up by the high velocity gas stream exiting from slots 44 (FIG. 3) in the extrusion head and are significantly stretched or elongated as they are carried downward. At an appropriate point in their travel the now stretched latent fiber strands 8 pass between two spray pipes 10, 12 and are contacted with a water spray or other regenerating liquid 14. The regenerated strands 15 are picked up by a rotating pickup roll 16 where they continuously accumulate at 18 until a sufficient amount of fiber has accumulated. At that time a new roll 16 is brought in to capture the fibers without slowing production, much as a new reel is used on a paper machine.

The surface speed of roll 16 is preferably slower than the linear speed of the descending fibers 15 so that they in essence festoon somewhat as they accumulate on the roll. It is not desirable that roll 16 should put any significant tension on the fibers as they are accumulated.

Alternatively, a moving foraminous belt may be used in place of the roll to collect the fibers and direct them to any necessary downstream processing.

The regeneration solution containing diluted NMMO or other cellulose solvent drips off the accumulated fiber 20 into container 22. From there it is sent to a solvent recovery unit where recovered NMMO can be reconcentrated and recycled back into the process.

Figure 3:
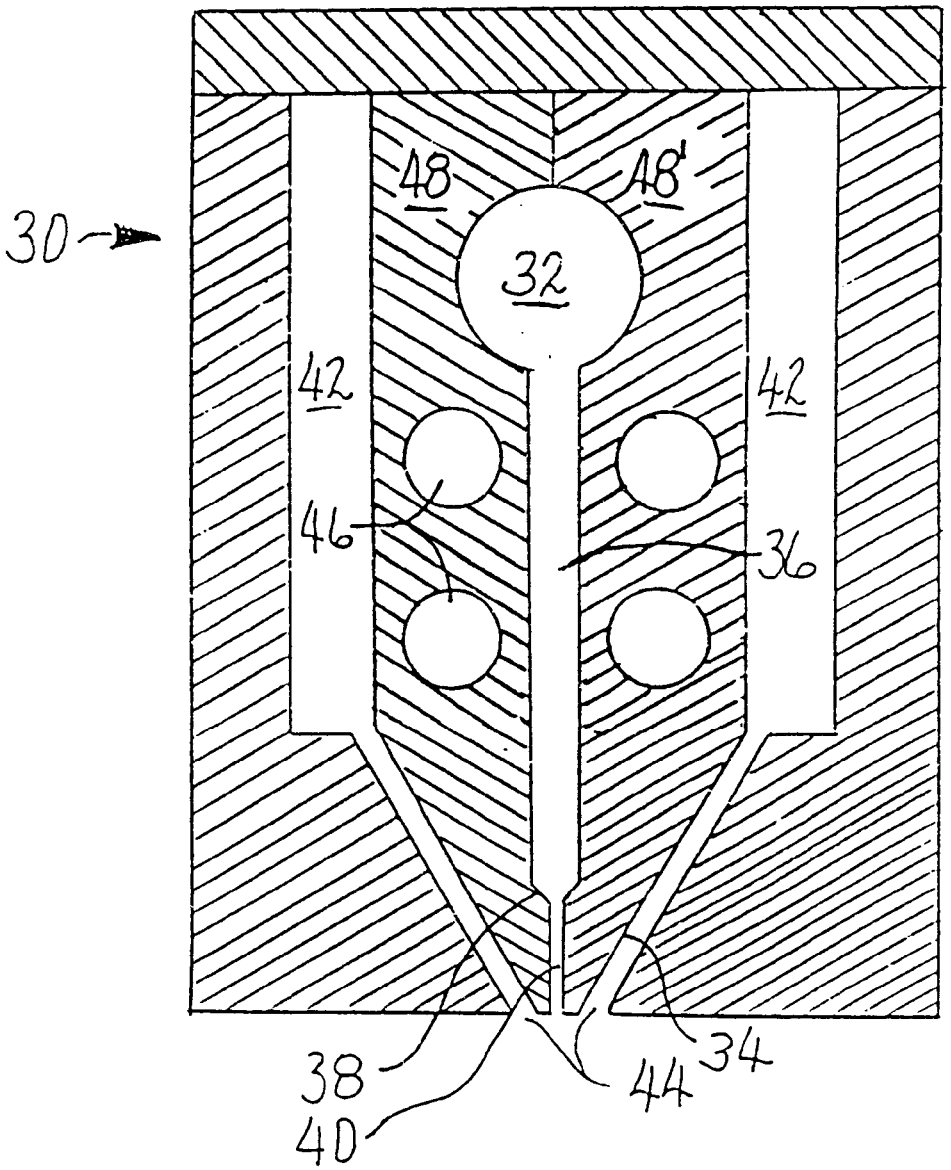
FIG. 3 is a cross sectional view of a typical extrusion head that might be used with the above melt blowing apparatus.

FIG. 3 shows a cross section of a typical extrusion head generally indicated at 30. A manifold or dope supply conduit 32 extends longitudinally through the nosepiece 34. Within the nosepiece a capillary or multiplicity of capillaries 36 descend from the manifold. These decrease in diameter smoothly in a transition zone 38 into the extrusion orifices 40. Gas chambers 42 also extend longitudinally through the die. These exhaust through slits 44 located adjacent the outlet end of the orifices. Internal conduits 46 supply access for electrical heating elements or steam/oil heat. The gas supply in chambers 42 is normally supplied preheated but provisions may also be made for controlling its temperature within the extrusion head itself.

As was noted earlier, a typical commercial lyocell fiber spinning head has orifice diameters of only about 60–80 $\mu$m. These extremely small orifices are difficult and expensive to machine and are readily plugged by small particles of foreign matter or undissolved cellulose. If plugging does occur the nozzles are extremely difficult to clean. The melt blowing technique of the present invention permits the use of nozzles from about 300–600 $\mu$m in diameter for forming fibers in the general 10–20 $\mu$m (cotton) diameter range at high production rates. These larger nozzles are much less subject to plugging and may be readily cleaned if needed. Further, small air bubbles or other foreign matter in the dope do not as frequently cause fiber breakage as with the commercially used 60–80 $\mu$m diameter nozzle orifices and production is not interrupted if a break does occur.

The capillaries and nozzles in the extrusion head nosepiece can be formed in a unitary block of metal by any appropriate means such as drilling or electrodischarge machining. Alternatively, due to the relatively large diameter of the orifices of the present invention, the nosepiece may be machined as a split die with matched halves 48, 48' (FIG. 3). This presents a significant advantage in machining cost and in ease of cleaning.

Example 3 that follows will give specific details of laboratory scale lyocell fiber preparation by melt blowing.

Figure 4:
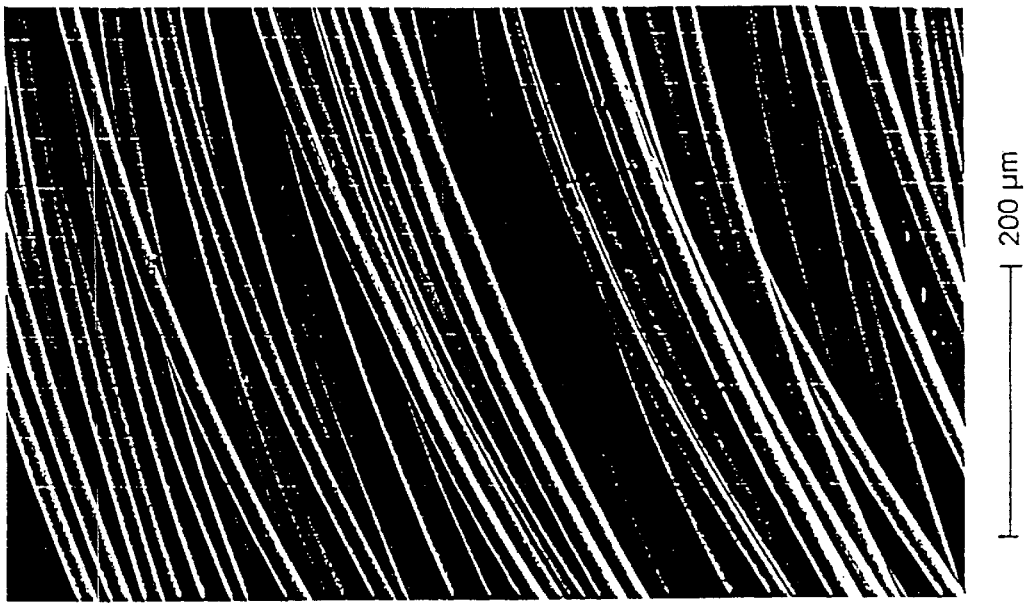
FIGS. 4 and 5 are scanning electron micrographs of a commercially available lyocell fiber at 100× and 10,000× magnification respectively.
Figure 5:
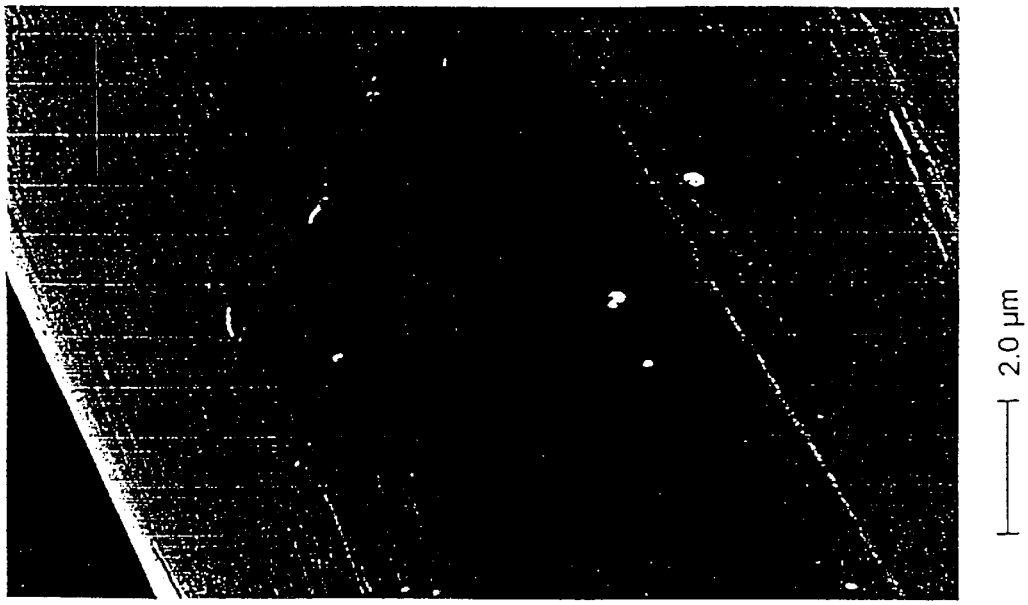
Figure 7:
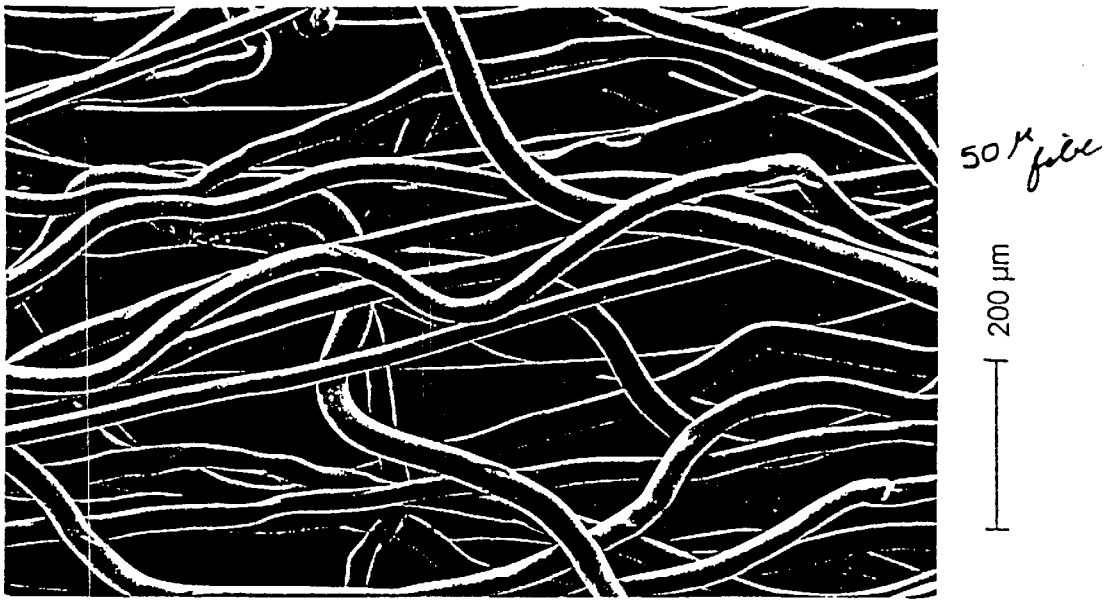
FIGS. 6 and 7 are scanning electron micrographs of a melt blown lyocell fiber at 100× and 10,000× magnification respectively.

The scanning electron micrographs shown in FIGS. 4–5 are of lyocell fibers made by the conventional continuously drawn process. It is noteworthy that these are of quite uniform diameter and are essentially straight. The surface seen at 10,000× magnification in FIG. 5 is remarkably smooth.

Figure 6:
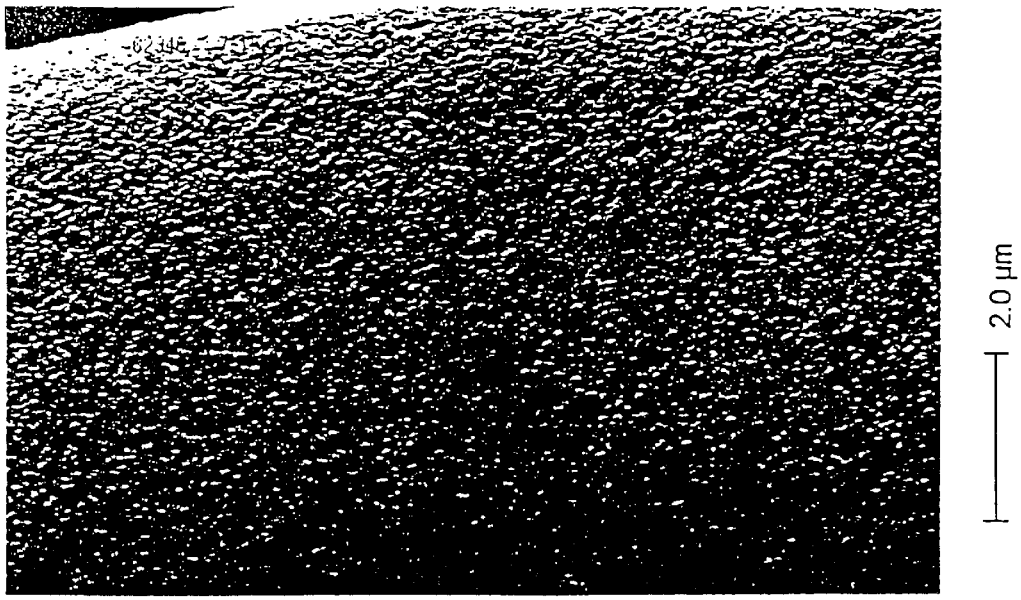

FIGS. 6. and 7 are low and high magnification scanning micrographs of melt blown lyocell fiber made by the process of the present invention. Fiber diameter, is variable and natural crimp of these samples is significant.

The overall morphology of fibers of the process is highly advantageous for forming fine tight yarns since many of the features resemble those of natural fibers. This is believed to be unique for the lyocell fibers of the present invention.

Fibrillation is defined as the splitting of the surface portion of a single fibers into microfibers or fibrils. The splitting occurs as a result of wet abrasion by attrition of fiber against fiber or by rubbing fibers against a hard surface. Depending on the conditions of abrasion, most or many will remain attached at one end to the mother fiber. The fibrils are so fine that they become almost transparent, giving a white, frosty appearance to a finished fabric. In cases of more extreme fibrillation, the micro-fibrils become entangled, giving the appearance and feel of pilling.

While there is no standard industry test to determine fibrillation resistance, the following procedure is typical of those used. 0.003 g of individualized fibers are weighed and placed with 10 mL of water in a capped 25 mL test tube (13×110 mm). Samples are placed on a shaker operating at low amplitude at a frequency of about 200 cycles per minute. The time duration of the test may vary from 4–80 hours. The samples shown in FIGS. 8–11 were shaken 4 hours.

Figure 8:
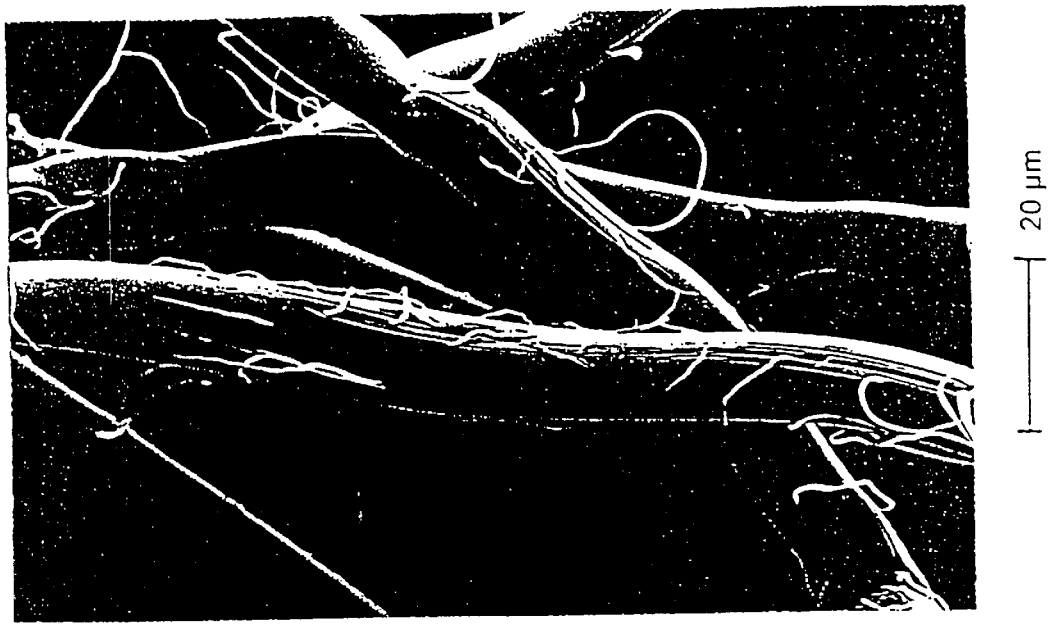
FIGS. 8 and 9 are scanning electron micrographs at 1000× of fibers from each of two commercial sources showing fibrillation caused by a wet abrasion test.
Figure 9:
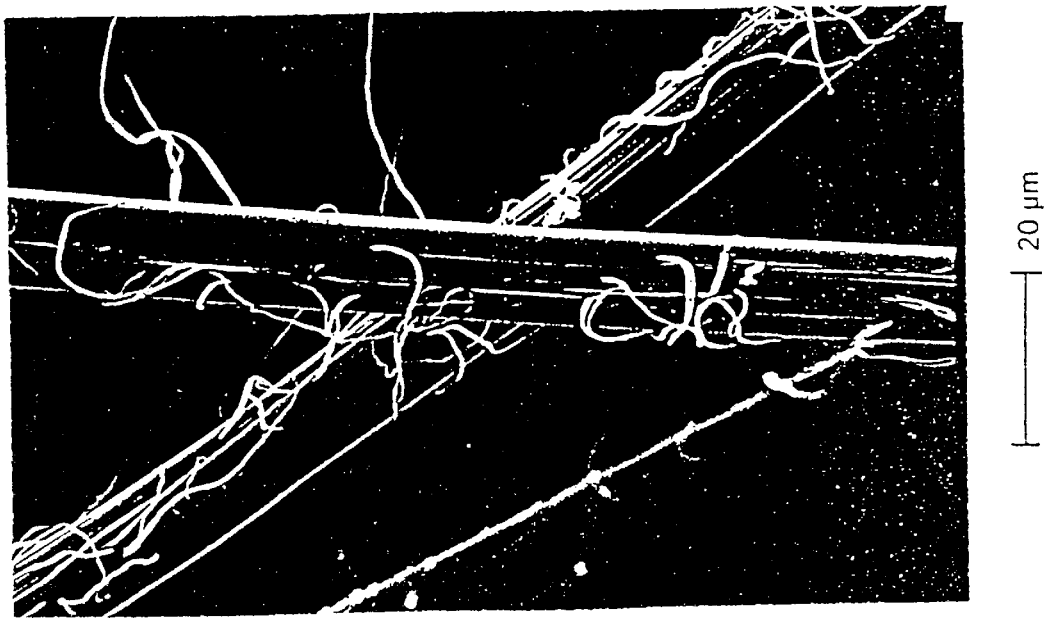
Figure 10:
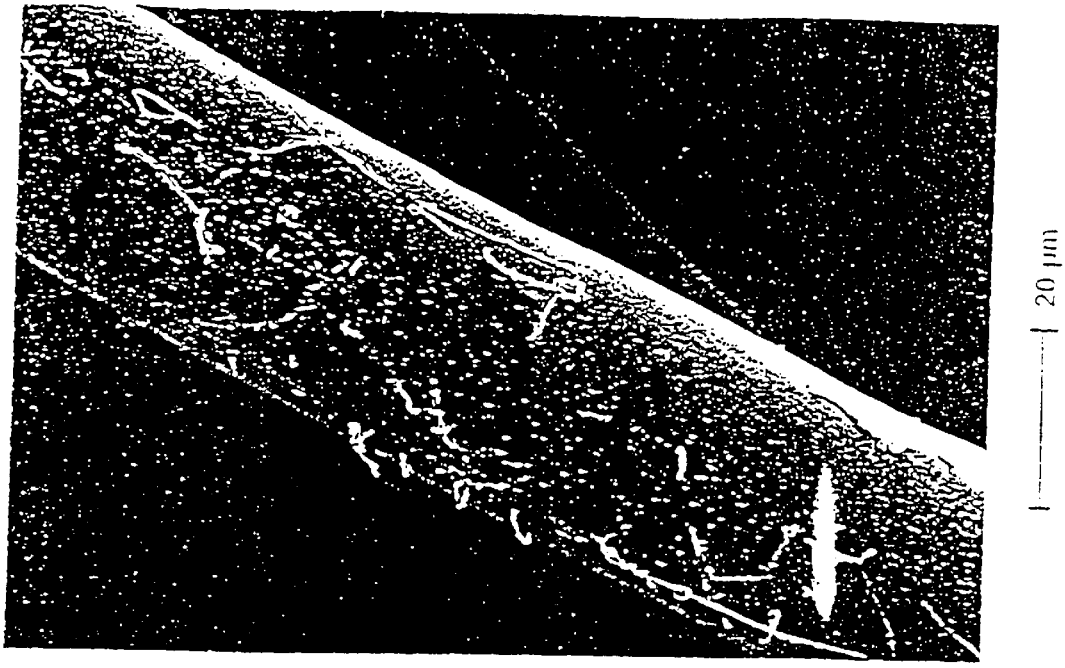
FIGS. 10 and 11 are scanning electron micrographs at 1000× of two fiber samples produced by the methods of the present-invention similarly submitted to the wet abrasion test.
Figure 11:
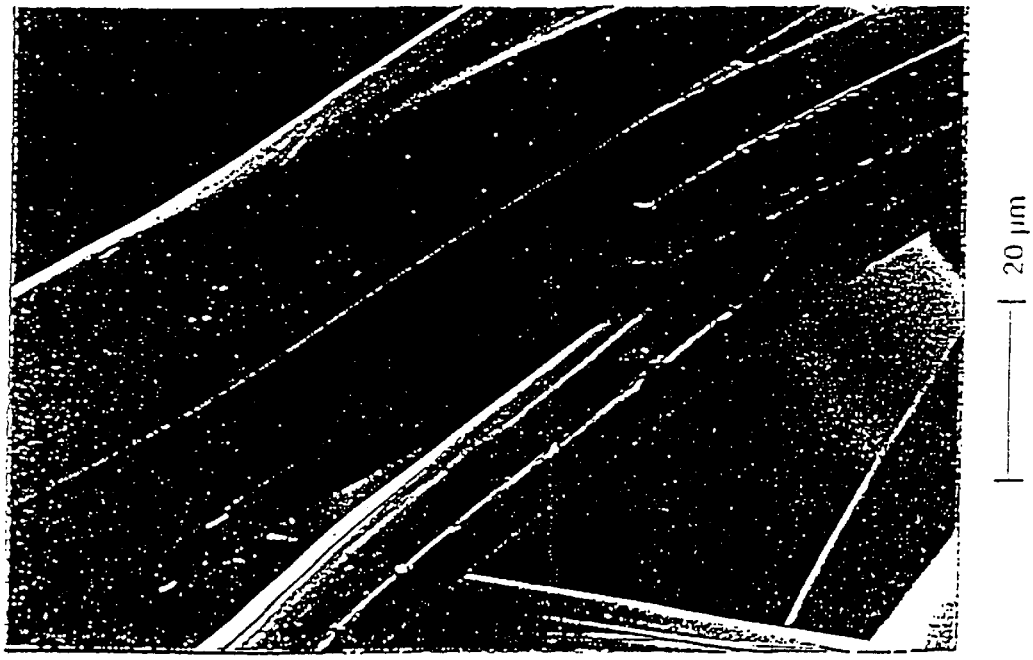

FIGS. 8 and 9 show the considerable fibrillation caused in fibers from commercially available yarns obtained from two different suppliers and tested as above. Compare these with FIGS. 10 and 11 which are two samples of melt blown fibers made by the present process. Fibrillation is very minor. The reasons for this are not fully understood. However, it is believed that the fibers of the present invention have somewhat lower crystallinity and orientation than those produced by existing commercial processes. In addition to the reduced tendency to fibrillate, the fibers of the invention also have been found to have greater and more uniform dye receptivity. The tendency to acquire a "frosted" appearance after use, caused by fibrillation, is almost entirely absent.

Figure 12:
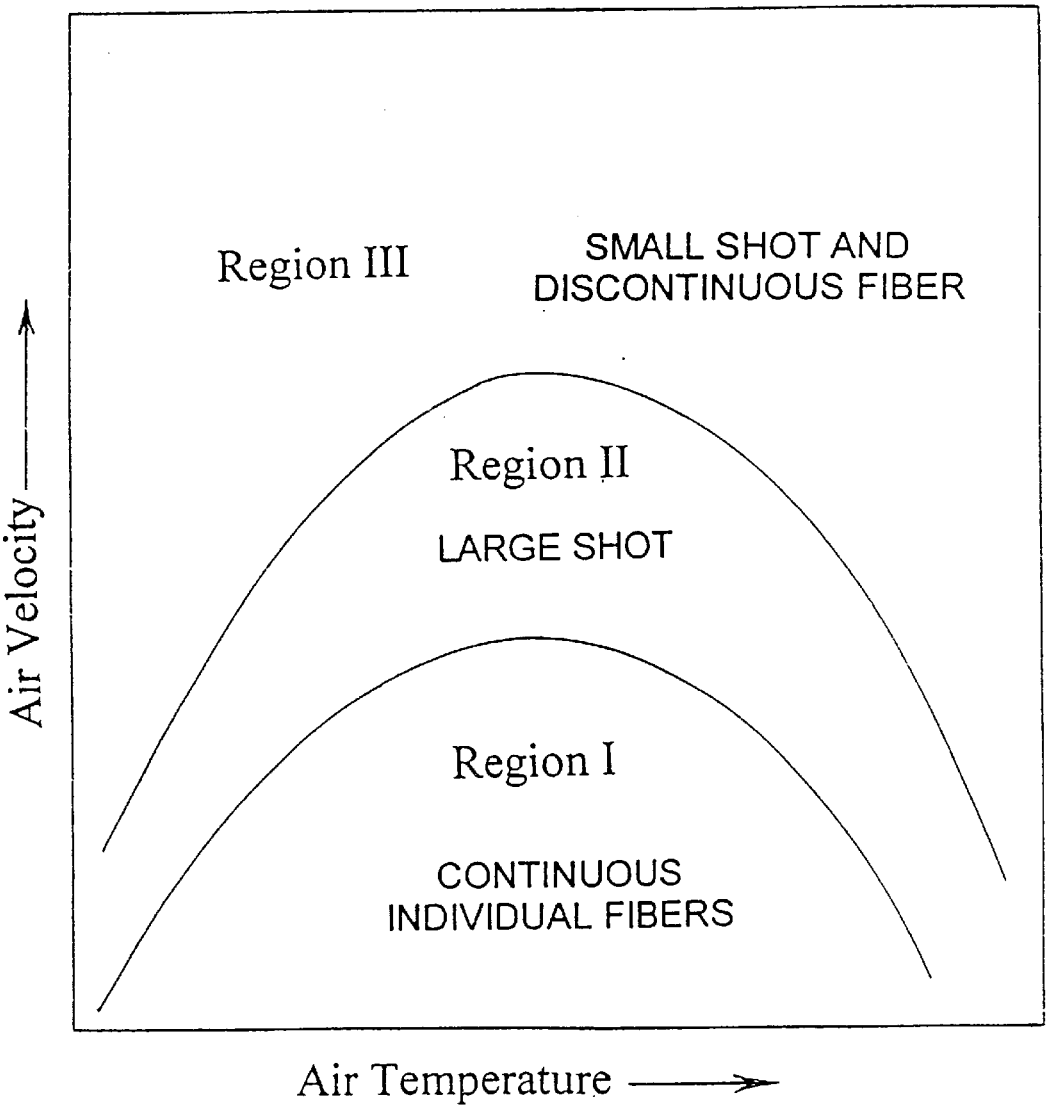
FIG. 12 is a graph showing melt blowing conditions where continuous shot free fibers can be produced.

FIG. 12 is a graph showing in general terms the Region I operating region to which the present process is limited. Region I is the area in which fibers are substantially continuous without significant shot, fly, or roping. Operation in this region is important for production of fibers of greatest interest to textile manufacturers. The exact operating condition parameters such as flow rates and temperatures will depend on the particular dope characteristics and specific melt blowing head construction and can be readily determined experimentally.

EXAMPLE 1

Cellulose Dope Preparation

The cellulose pulp used in this and the following examples was a standard bleached kraft southern softwood market pulp, Grade NB 416, available from Weyerhaeuser Company, New Bern, N.C. It has an alpha cellulose content of about 88–89% and a D.P. of about 1200. Prior to use, the sheeted wood pulp was run through a fluffer to break it down into essentially individual fibers and small fiber clumps. Into a 250 mL three necked glass flask was charged 5.1 g of fluffed cellulose, 66.2 g of 97% NMMO, 24.5 g of 50% NMMO, and 0.05 g propyl gallate. The flask was immersed in an oil bath at 120° C., a stirrer inserted, and stirring continued for about 0.5 hr. Cellulose concentration was about 5.3%. A readily flowable dope resulted that was directly suitable for spinning.

EXAMPLE 2

The procedure of Example 1 was repeated except that 23.0 g of microcrystalline cellulose was substituted for the NB 416 pulp. Other components were unchanged. The microcrystalline cellulose was Avicel® Type PH-101 available from FMC Corp., Newark, Del. Degree of polymerization of this product is approximately 215. The resulting readily flowable solution had a cellulose concentration of about 20.2% cellulose.

EXAMPLE 3

The procedure of Example 1 was repeated using 9.0 g of hydrolyzed NB 416 with a D.P. of about 600. Hydrolysis was carried out in suspension in 2.5N $H_2SO_4$ at about 85° C. for about 1 hour. After hydrolysis the pulp was dried before dissolving in the aqueous NMMO. The resulting cellulose dope had a cellulose content of about 9.0%. The dope viscosities of the products of Examples 1–3 were similar.

EXAMPLE 4

Lyocell Fiber Preparation by Melt Blowing

The dopes as prepared in Examples 1–3 were maintained at about 120° C. and fed to a single orifice laboratory melt blowing head. Diameter at the orifice of the nozzle portion was 483 μm and its length about 2.4 mm, a L/D ratio of 5. A removable coaxial capillary located immediately above the orifice was 685 μm in diameter and 80 mm long, a L/D ratio of 116. The included angle of the transition zone between the orifice and capillary was about 118°. The air delivery ports were parallel slots with the orifice opening located equidistant between them. Width of the air gap was 250 μm and overall width at the end of the nosepiece was 1.78 mm. The angle between the air slots and centerline of the capillary and nozzle was 30°. The dope was fed to the extrusion head by a screw activated positive displacement piston pump. Air velocity was measured with a hot wire instrument as 3660 m/min. The air was warmed within the electrically heated extrusion head to 60° C. at the discharge point. Temperature within the capillary without dope present ranged from about 80° C. at the inlet end to approximately 140° C. just before the outlet of the nozzle portion. It was not possible to measure dope temperature in the capillary and nozzle under operating conditions. When equilibrium running conditions were established a continuous fiber was formed from each of the dopes. Throughputs were varied somewhat in an attempt to obtain similar fiber diameters with each dope but all were greater than 1 g of dope per minute. Fiber diameters varied between about 9–14 μm at optimum running conditions.

A fine water spray was directed on the descending fiber at a point about 200 mm below the extrusion head and the fiber was taken up on a roll operating with a surface speed about ¼ the linear speed of the descending fiber.

A continuous fiber in the cotton denier range could not be formed when the capillary section of the head was removed. The capillary appears to be very important for formation of continuous fibers and in reduction of die swell.

It will be understood that fiber denier is dependent on many controllable factors. Among these are solution solids content, solution pressure and temperature at the extruder head, orifice diameter, air pressure, and other variables well known to those skilled in melt blowing technology. Lyocell fibers having deniers in the cotton fiber range (about 10–20 μm in diameter) were easily and consistently produced by melt blowing at throughput rates greater than 1 g/min of dope per orifice. A 0.5 denier fiber corresponds to an average diameter (estimated on the basis of equivalent circular cross sectional area) of about 7–8 μm.

The fibers of the present invention were studied by x-ray analysis to determine degree of crystallinity and crystallite type. Comparisons were also made with some other cellulosic fibers as shown in the following table. Data for the fibers are taken from the melt blown material using the dope of Example 3.

TABLE I

Crystalline Properties of Different Cellulose Fibers

| Fibers | Lyocell of Present Invention | Tencel ® | Cotton |
|---|---|---|---|
| Crystallinity Index | 67% | 70% | 85% |
| Crystallite | Cellulose II | Cellulose II | Cellulose I |

Some difficulty and variability was encountered in measuring tensile strength of the individual fibers so the numbers given in the following table for tenacity are estimated averages. Again, the fibers of the present invention are compared with a number of other fibers as seen in Table 2.

TABLE 2

Fiber Physical Property Measurements

| Fibers | Cotton | So. Pine | Rayon[1] | Silk | Melt Blown Lyocell[2] | Tencel |
|---|---|---|---|---|---|---|
| Typical Length, cm | 4 | 0.5 | 40 | >104 | Continuous | Variable |
| Typical Diam., μm | 20 | 40 | 16 | 10 | 9–15 | 12 |
| Tenacity, g/d | 2.5–3.0 | — | 0.7–3.2 | 2.8–5.2 | 2–3 | 4.5–5.0 |

[1]Viscose process.
[2]Made with 600 D.P. cellulose dope of Example 3.

The pebbled surface of the fibers of the present invention result in a desirable lower gloss without the need for any internal delustering agents. While gloss or luster is a difficult property to measure the following test will be exemplary of the differences between a melt blown fiber sample made using the dope of Example 3 and a commercial lyocell fiber. Small wet formed handsheets were made from the respective fibers and light reflectance was determined. Reflectance of the Example 4 material was 5.4% while that of the commercial fiber was 16.9%.

EXAMPLE 5

The fibers of the present invention have shown an unusual and very unexpected affinity for direct dyes. Samples of the melt blown fibers made from the dope of Example 3 were carded and spun. These were placed in two dye baths, Congo Red and Chicago Sky Blue 6B, along with samples of undyed commercial lyocell from two suppliers. The color saturation of the dyed melt blown fibers was outstanding in comparison to that of the commercially available fibers used for comparison. It appears that quantitative transfer of dye to the fiber is possible with the fibers of the invention.

EXAMPLE 6

Fiber made from the dope of Example 3 was removed from a takeup roll, as shown in FIG. 2, and cut by hand into 38–40 mm staple length. The resultant fiber bundles were opened by hand to make fluffs more suitable for carding. The tufts of fiber were arranged into a mat that was approximately 225 mm wide by 300 mm long and 25 mm thick. This mat was fed into the back of a full size cotton card set for cotton processing with no pressure on the crush rolls. Using a modified feed tray the card sliver was arranged into 12 pieces of equal lengths. Since the card sliver weight was quite low this was compensated for on the draw frame. Two sets of draw slivers were processed from the card sliver. These sets were broken into equal lengths and placed on the feed tray. This blended all the sliver produced into one finish sliver. The finish sliver was 4.95 meters long and weighed 20.9 g. A rotor spinning machine was used to process the finish sliver into yarn. The rotor speed was 60,000 rpm with an 8,000 rpm combing roll speed. The yarn count was estimated as between 16/1 and 20/1. The machine was set up with a 4.00 twist multiple. The yarn was later successfully knitted on a Fault Analysis Knitter with a 76 mm cylinder.

The fiber made with the low D.P. cellulose of Example 2 did not card well and there was some fiber breakage.

The inventors have herein described the best present mode of practicing their invention. It will be evident to others skilled in the art that many variations that have not been exemplified should be included within the broad scope of the invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A lyocell fiber having a hemicellulose content of between about 13% and about 15%, and having a greater variability in cross sectional diameter and cross sectional configuration along the fiber length compared to variability in cross sectional diameter and cross sectional configuration along the fiber length of lyocell fibers produced by a continuously drawn process.

2. The lyocell fiber of claim 1 wherein the lyocell fiber has an irregular amplitude greater than about one lyocell fiber diameter.

3. The lyocell fiber of claim 1 wherein the lyocell fiber has an irregular period greater than about five fiber diameters.

4. The lyocell fiber of claim 1 wherein the lyocell fiber has a diameter of from about 10 to about 20 micrometers.

5. The lyocell fiber of claim 1 wherein the lyocell fiber has a tenacity of about 2 to about 3 g/d.

* * * * *